United States Patent [19]

Nagano et al.

[11] Patent Number: 4,944,263

[45] Date of Patent: Jul. 31, 1990

[54] CYLINDER HEAD OF DOHC ENGINE

[75] Inventors: Seishi Nagano; Masayuki Hashimoto, both of Kanagawa; Akira Murasaki, Yokohama, all of Japan

[73] Assignees: Nissan Motor Co., Ltd., Yokohama; Nissan Kohki Co., Ltd., Kanagawa, both of Japan

[21] Appl. No.: 436,654

[22] Filed: Nov. 15, 1989

[30] Foreign Application Priority Data

Nov. 16, 1988 [JP] Japan ..... 63-149498[U]

[51] Int. Cl.[5] ..... F02F 1/00

[52] U.S. Cl. ..... 123/193 H; 123/90.27; 123/195 H

[58] Field of Search ..... 123/193 H, 195 H, 41.82 R, 123/90.27

[56] References Cited

U.S. PATENT DOCUMENTS 4,615,308 10/1986 Asanomi et al. ..... 123/90.27
4,685,429 8/1987 Oyaizu ..... 123/90.27
4,709,667 12/1987 Ichihara et al. ..... 123/90.27

FOREIGN PATENT DOCUMENTS 61-17162 1/1986 Japan .

*Primary Examiner*—Andrew M. Dolinar
*Assistant Examiner*—M. Macy
*Attorney, Agent, or Firm*—Foley & Lardner, Schwartz, Jeffery, Schwaab, Mack, Blumenthal & Evans

[57] ABSTRACT

To increase the rigidity of camshaft bearing portions of the cylinder head on the camshaft driving side of an DOHC engine, an each member for symmetrically supporting two camshafts is formed integral with the cylinder head in such a way that the inner arcuate surface thereof extends to both inner side walls of the cylinder head.

7 Claims, 8 Drawing Sheets

BOTTOM VIEW

CYLINDER HEAD OF DOHC ENGINE

BACKGROUND OF THE INVENTION

1. Field of the Invention

The present invention relates to a cylinder head for a DOHC engine, and more specifically to a cylinder head structure for providing a higher camshaft supporting rigidity.

2. Description of the Prior Art

To obtain higher engine performance in automotive vehicles, DOHC (double overhead camshaft) engines have been widely used, in which two different camshafts for driving intake and exhaust valves separately are provided on a cylinder head. An example of these DOHC engines is disclosed in Japanese Published Unexamined (Kokai) Utility Model Application No. 61-17162, for instance. In this disclosed DOHC engine, as shown in FIG. 1 two camshafts 2A and 2B are rotatably supported on two bearing portions 3A and 3B formed on a cylinder head 1, and a plurality of ignition plugs (not shown) are inserted into plural cylindrical plug insertion bosses 4 formed along the central line of the cylinder head 1. Further, a number of reinforcement ribs 5A and 5B are formed integral with the cylinder head 1 so as to extend between the bearing portions 3A and 3B and the cylindrical plug insertion bosses 4 in order to increase the rigidity of the cylinder head 1 at which the two camshafts 2A and 2B are supported.

In the prior-art cylinder head as described above, however, since no cylindrical plug insertion bosses 4 can be formed at the bearing portions on both the front and rear sides along the cylinder arrangement line of the cylinder head 1, it is impossible to form the above-mentioned reinforcement ribs 5 on both the sides of the cylinder head 1. In the cylinder head for a DOHC engine, however, since camshaft driving elements such as chain wheels, chains, belt pulleys, etc. are usually attached to the front end of the camshafts 2A and 2B in order to drive the camshafts, a torque is inevitably applied to each camshaft by the camshaft driving elements therefore a load is applied in the obliquely downward direction at the camshaft bearing portions and therefore the front end camshaft bearing portions are deformed, so that the camshafts are scratched by the deformed camshaft bearing portions of the cylinder head. In other words, in the prior-art cylinder head for a DOHC engine, there exists a problem in that the rigidity of the cylinder head 1 is not sufficient at the camshaft bearing portions 3A and 3B and therefore the camshaft supporting surfaces are deformed or the camshafts are damaged due to journal scuff (scratches).

SUMMARY OF THE INVENTION

With these problems in mind therefore, it is the primary object of the present invention to provide a cylinder head for an DOHC engine which can effectively increase the rigidity of the front end (the camshaft driving end) of the cylinder head for prevention of camshaft journal scuff (scratches).

To achieve the above-mentioned object, the cylinder head for a DOHC engine according to the present invention is characterized in that an arch member (20) is formed integral with the cylinder head (100) on a front camshaft driving end to support the two camshafts (50) in such a way that an inner arcuate surface (20A) of said arch member extends to both inner side wells (111, 112) of the cylinder head (100).

The two camshafts are supported by the arch member in symmetrical positional relationship to each other to cancel horizontal compression stresses generated in said arch member when the two camshafts are driven by a chain. The arch member is reinforced by two stays (121, 122) also formed integral with the cylinder head between a cylinder head upper deck (120) and the inner arcuate surface (20A) of the arch member.

Further, the arch member is formed with a central recessed portion (27) in the arcuate surface thereof between the two camshaft supporting portions and with two side recessed portions (28) in the inner arcuate surface thereof below the two camshaft supporting portions.

In the cylinder head for a DOHC engine according to the present invention, since an arch member is formed integral with the cylinder head at the camshaft driving end to support the two camshafts, load applied to the two camshaft bearing portions by the camshaft driving elements can be effectively received by the arch member supported by the two inner side walls and two stays of the cylinder head. In this case, the compression stresses generated on both sides of the arch member can cancel each other in the horizontal direction without deforming the arch member. Further, since the arch member is formed with the arcuate surface extending to the inner side walls of the cylinder head, the compression stress generated in the arch member can be divided into two opposite inner side walls. Therefore, it is possible to markedly increase the rigidity of the cylinder head at the camshaft bearing portions.

Further, since the front end surface of the arch member is located frontward away from the front end surface (120A) of the upper deck (120), lubricant can be smoothly returned to an oil pan along the front end surface of the cylinder head without lubricant accumulation. Further, it is also possible to arrange chain sprocket wheel near and along the inner arcuate surface of the arch member to reduce the engine size.

DETAILED DESCRIPTION OF THE PREFERRED EMBODIMENTS

Figure 1:
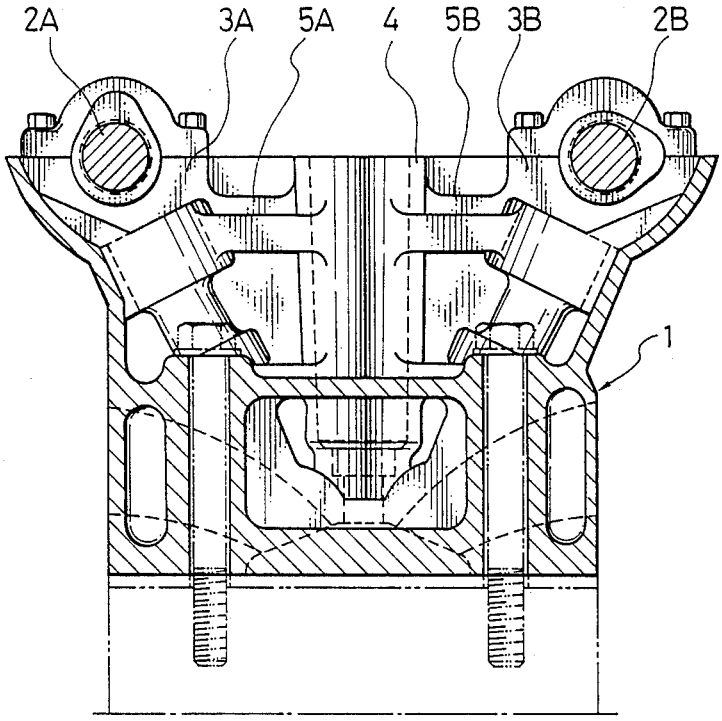
FIG. 1 PRIOR ART
FIG. 1 is a front cross-sectional view showing a prior-art cylinder head for a DOHC engine.
Figure 2:
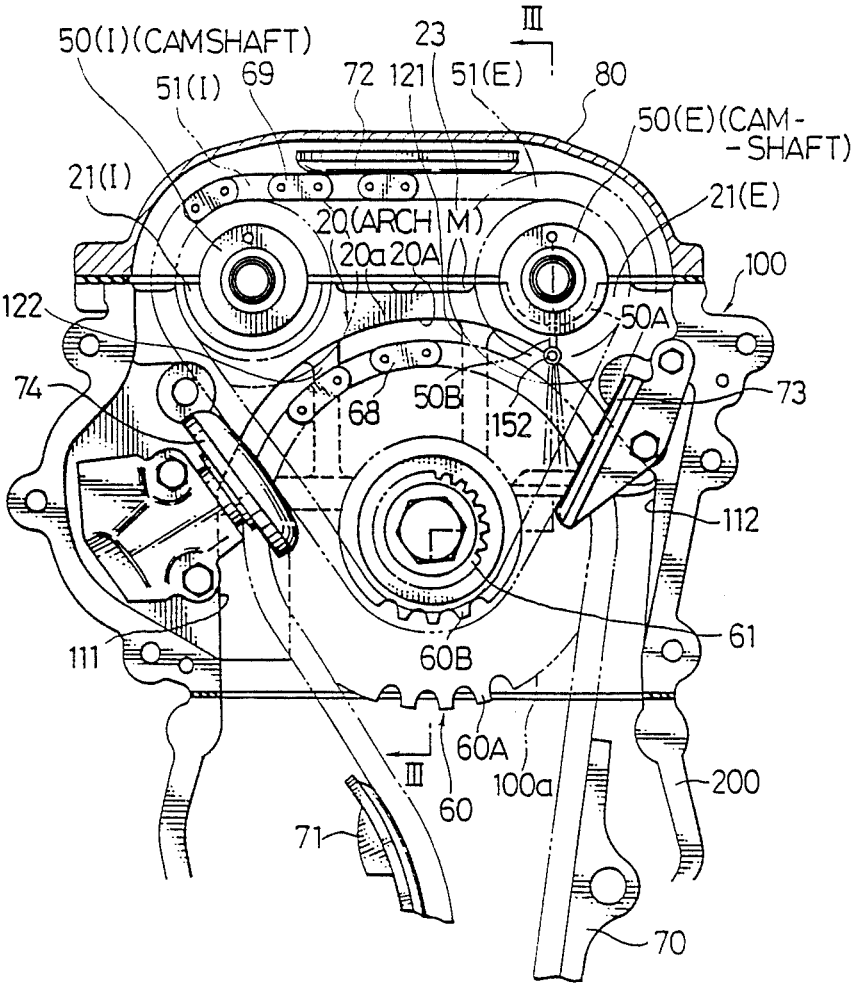
FIG. 2 is a front view showing a cylinder head for a DOHC engine according to the present invention to which a camshaft driving mechanism is incorporated.
Figure 3:
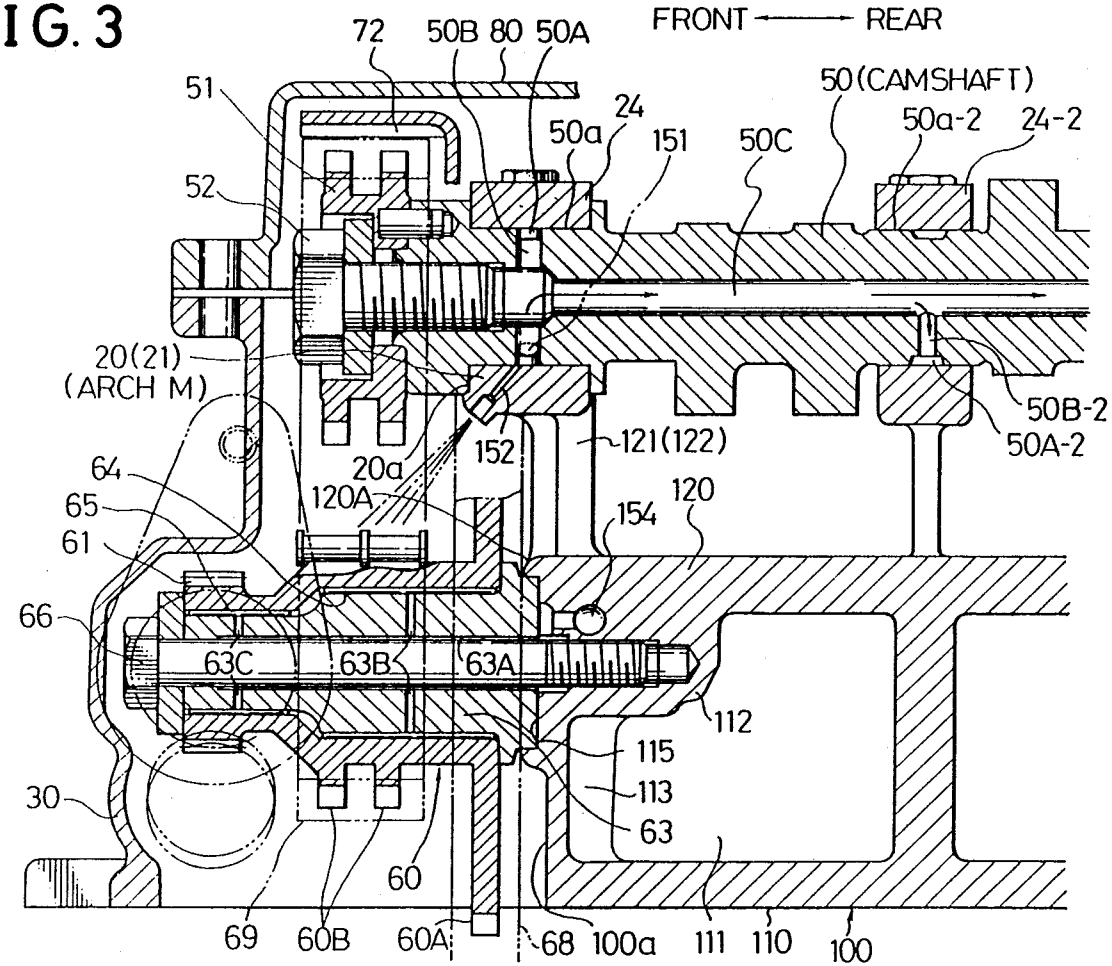
FIG. 3 is a cross-sectional view taken along the line III—III in FIG. 2.

Embodiments of the cylinder head for a DOHC engine according to the present invention will be described hereinbelow with reference to the attached drawings. With reference to FIGS. 2 and 3, a two-camshaft driving mechanism arranged at the front end of a cylinder head 100 will first be described. An idler sprocket 60 is provided between two camshafts 50 and a crankshaft (not shown) attached to a cylinder block 200 (FIG. 2).

The idler sprocket 60 is driven by the crankshaft via a first chain 68; the two camshafts 50 are driven by the idler sprocket 60 via a second chain 69; and a distributer unit (not shown) is driven by a distributer driving gear 61 fixed to the idler sprocket 60. In addition, the distributer unit is mounted at any desired inclination angle on the front cover (not shown) for covering the idler sprocket 60.

In more detail, an intake camshaft 50(I) is supported at the intake camshaft bearing portion 21(I) of an arch member 20 formed integral with the cylinder head 100. An exhaust camshaft 50(E) is supported at the exhaust camshaft bearing portion 21(E) of the same arch member 20. Intake valves (not shown) are driven open or closed by the intake camshaft 50(I) and exhaust valves (not shown) are driven open or closed by the exhaust camshaft 50(E). An intake camshaft sprocket 51(I) having two sprocket wheels is fixed to the intake camshaft 50(I) by a bolt 52(I) and similarly an exhaust camshaft sprocket 51(E) having two sprocket wheels is fixed to the exhaust camshaft 50(E) by a bolt 52(E).

Under the two camshafts 50(I) and 50(E), an idler sprocket 60 and a helical distributer driving gear 61 are rotatably supported by an idler shaft 63 (fitted to a recess 115 formed in the cylinder head 100) via two bearing members (bushed) 64 and 65, respectively. The idler sprocket 60, the helical distributer driving gear 61 and the idler shaft 63 are all attached together to the cylinder head 100 with a bolt 66. The idler sprocket 60 is formed with a first sprocket (large diameter) chain wheel 60A and two second sprocket (small diameter) chain wheels 60B. In this embodiment shown in FIG. 3, the helical distributer driving gear 61 is formed integral with the idler sprocket 60. The helical distributer driving gear 61 is engaged with a helical distributer driven gear (not shown) of a distributer unit (not shown).

The first sprocket chain wheel 60A is driven by the crankshaft (not shown), because a first chain 68 is reeved around a crankshaft chain wheel (not shown) and the first sprocket chain wheel 60A. Further, the two intake and exhaust camshaft sprockets 51(I) and 51(E) are driven by the idler sprocket 60 in synchronism with the crankshaft, because a second chain 69 is reeved around the two second sprocket chain wheels 60B and the two sprocket wheels 51 of each of the intake and exhaust camshafts 50(I) and 50(E).

As shown in FIG. 2, the first chain 68 is guided by a first chain guide 70, and an appropriate tension is applied to the first chain 68 by a first chain tensioner 71. In the same way, the second chain 69 is guided by two second chain guides 72 and 73, and an appropriate tension is applied to the second chain 69 by a second chain tensioner 74. Further, the first chain 68 is arranged under the arch member 20 near and along an inner arcuate wall surface 20A thereof formed so as to extend from the two inner side surfaces 111 and 112 of the cylinder head 100.

Further, as shown in FIG. 3, the front cover 30 is fixed to the front side of the cylinder head 100 with bolts, and further a rocker cover 80 is fixed to the upper surfaces of the cylinder head 100 and the front cover 30.

In operation, when the engine is running, since the crankshaft (not shown) is rotated, the idler sprocket 60 is driven by the crankshaft via the first chain 68, so that the intake and exhaust camshaft sprockets 51(I) and 51(E) are driven by the idler sprocket 60 via the second chain 69 to open and close intake and exhaust valves at proper timing. On the other hand, since the helical distributer driving gear 61 is formed integral with the idler sprocket 60, the distributer unit is driven by the helical distributer driven gear in mesh with the helical distributer driving gear 61, so that ignition plugs provided for engine cylinders are ignited in sequence by a high tension (volt) generated by the distributer unit driven as described above.

Figure 4:
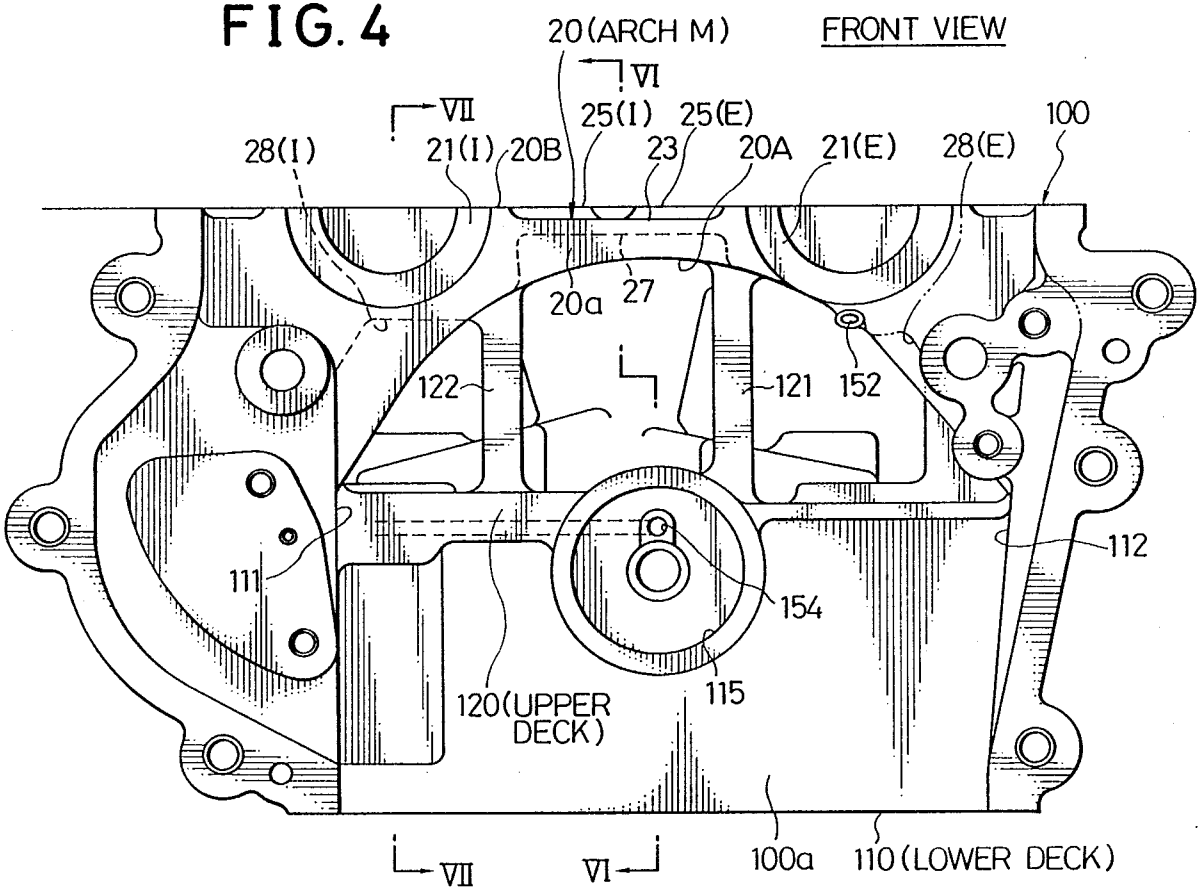
FIG. 4 is a front view showing the cylinder head according to the present invention.
Figure 5:
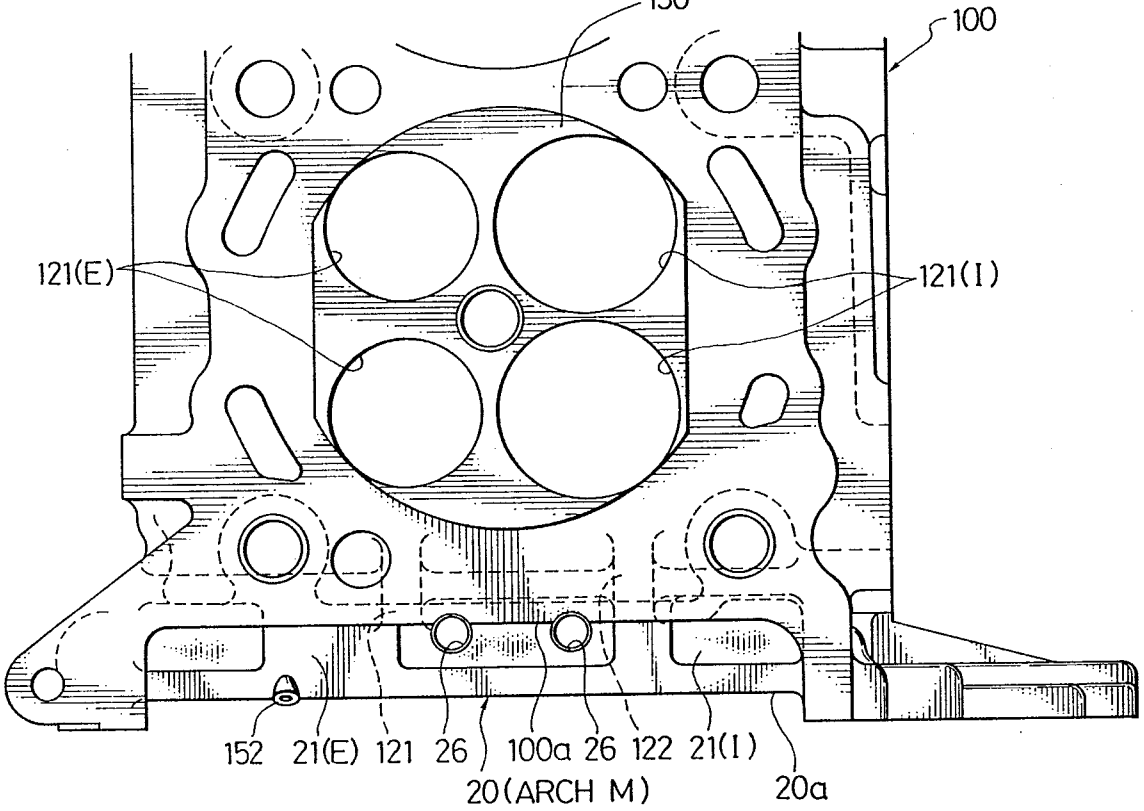
FIG. 5 is a bottom view showing the cylinder head.

A complicated structure of the cylinder head 100 will now be explained below. With reference to FIGS. 3, 4 and 5, the cylinder head 100 is formed with a lower deck 110 fixed to a cylinder block 200 (FIG. 2) and an upper deck 120. As shown in FIG. 5, two intake ports 121(I) and two exhaust ports 121(E) are formed on the upper deck 120. A water jacket 111 (FIG. 3) is also formed between the lower deck 110 and the upper deck 120.

An idler sprocket boss portion 112 (FIG. 3) to which the bolt 66 for mounting the idler sprocket 60 to the cylinder head 100 is formed between the lower deck 110 and the upper deck 120. Further a rib 113 (FIG. 3) is formed between the lower deck 110 and the idler sprocket boss portion 112 for providing a higher rigidity. Since the above boss portion 112 is formed inward away from the front wall **100*a* of the cylinder head 100, it is possible to prevent the idler sprocket 60 from greatly projecting from the front end surface 100*a* of the cylinder head 100, thus reducing the engine size. Further, since the above boss portion 112 is formed remote from the wall 130A (FIGS. 5 and 6) of the combustion chamber 130, it is possible to prevent the idler sprocket 60** from being heated.

On the front upper portion of the cylinder head 100, the arch member 20 including the intake bearing portion 21(I) for rotatably supporting the intake camshaft 50(I) and the exhaust bearing portion 21(E) for rotatably supporting the exhaust camshaft 50(E) is formed integral with the cylinder head 100. This arch member 20 is formed with an inner arcuate surface 20A extending from the left side wall 111 and the right side wall 112 of the cylinder head 100 as depicted in FIG. 4. Under the arch member 20, the first chain 68 reeved around the idler sprocket 60 is disposed being spaced from the inner arcuate surface 20A thereof. A front cylinder head wall **100*a* (FIG. 3) connecting the lower deck 110 and the upper deck 120 is located a little rearward away from a front arch member wall 20*a* so that the idler sprocket 60 and the first chain 68 can be accommodated deep under the arch member 20**.

As shown in FIG. 4, a recessed portion 23 is formed on the upper surface 20B of the arch member 20 to fix two bearing caps 24 (FIG. 3). Further, two boss portions 25(I) and 25(E) (FIG. 4) having threaded holes 26(I) and 26(E) (FIG. 5) for fixing the bearing caps 24 with bolts, respectively are formed in the recessed portion 23 of the arch member 20.

Figure 6:
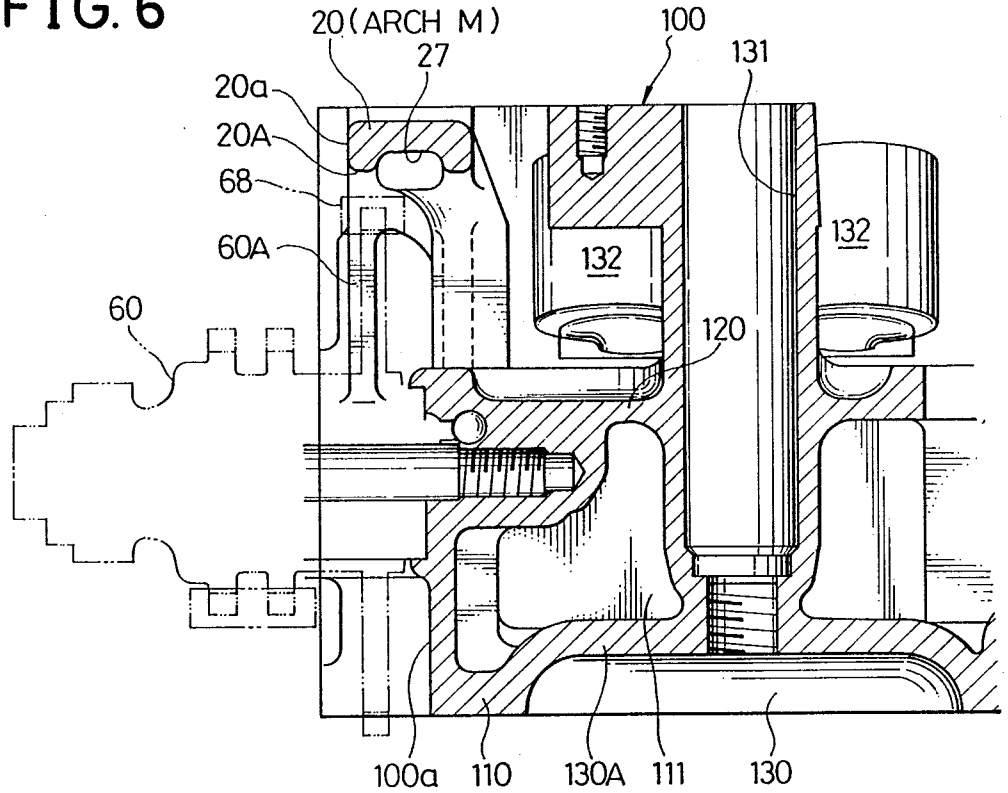
FIG. 6 is a cross-sectional view taken along the line VI—VI in FIG. 4.

As shown in FIGS. 4 and 6, a recessed (thin wall) portion 27 is formed in the arcuate surface 20A of the arch member 20 between the two camshaft bearing portions 21(I) and 21(E) to reduce the cylinder head weight. Further, as shown in FIG. 4, two recessed (thin wall) portions 28(I) and 28(E) are similarly formed in the arcuate surface 20A of the arch member 20 under the two camshaft bearing portions 21(I) and 21(E) also to reduce the cylinder head weight.

Figure 7:
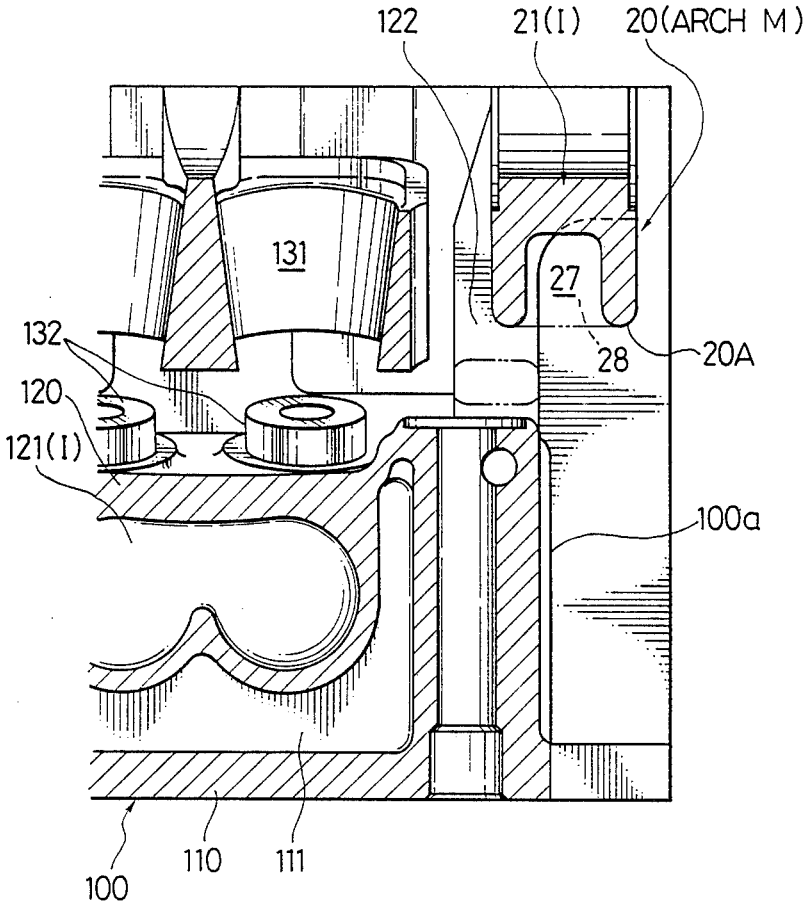
FIG. 7 is a cross-sectional view taken along the line VII—VII in FIG. 4.

Further, with reference to FIGS. 6 and 7, each cylindrical plug insertion boss portion 131 is formed vertically at the center of each combustion chamber 130, and four boss portions 132 to which intake and exhaust valves are inserted are formed also vertically so as to surround the cylindrical plug insertion boss portion 131.

The lubricant passages will be described hereinbelow with reference to FIGS. 3 and 4. To lubricate the two camshafts 50(I) and 50(E) at the two journal portions **50*a* between the camshafts 50 and the arch member 20 or the bearing caps 24, inclined oil passages 151(I) and 151(E) connected to a main oil passage (not shown) are formed on the upper portion of the cylinder head 100, respectively. On the other hand, each camshaft 50 is formed with an annular oil groove 50A communicating with the inclined oil passage 151, two radial oil passages 50B communicating with the annular oil groove 50A, and an axial oil passage 50C communicating with the two radial oil passages 50B. Lubricant passing through the axial oil passage 50C also lubricates another journal portion 50*a*-2 of another bearing cap 24-2 arranged adjacent to the frontmost bearing cap 24 through the similar radial oil passages 50B-2 and the annular oil groove 50A-2. Therefore, lubricant flows from the main oil passage (not shown) to the axial oil passage 50C by way of the inclined oil passage 151, the annular oil groove 50A and the two radial oil passages 50B**.

Further, an inclined oil jet hole 152 is obliquely formed in the camshaft bearing portion 21 of the annular member 20 so as to be oriented toward the second chain 69 in communication with the annular oil groove 50A formed in the camshaft 50. Therefore, lubricant is jetted from this oil jet hole 152 to the second chain 69 for lubrication.

Further, another oil passage 154 is formed in the upper deck 120 of the cylinder head 100 so that lubricant can be supplied to the two bearing members (bushes) 64 and 65 of the idler sprocket 60 via a gap 63A formed between the idler shaft 63 and the bolt 66 and plural radial oil passages 63B and 63C formed in the idler shaft 63.

Figure 8:
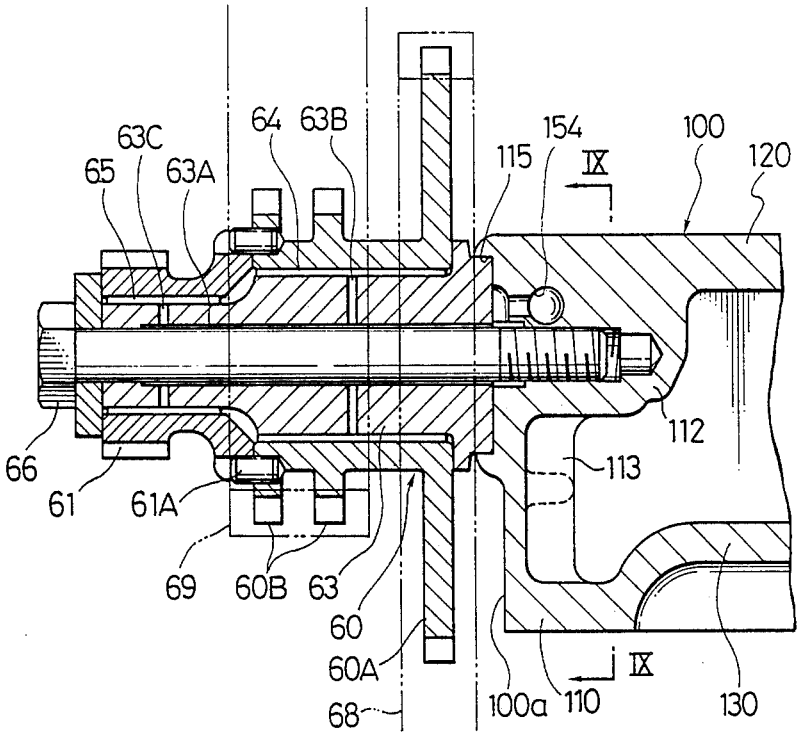
FIG. 8 is a cross-sectional view for assistance in explaining another embodiment of the idler sprocket wheel attached to the cylinder head.
Figure 9:
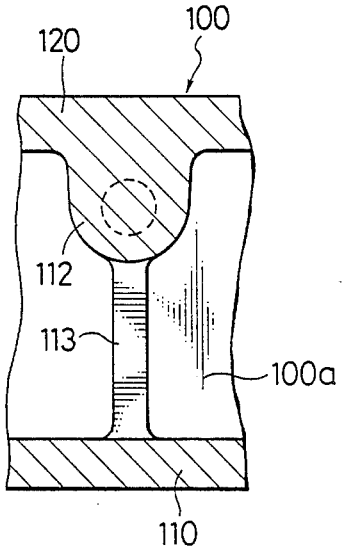
FIG. 9 is a cross-sectional view taken along the line IX—IX in FIG. 8.

FIGS. 8 and 9 show another embodiment of the idler sprocket 60, in which the helical distributer driving gear 61 is fixed to the idler sprocket 60 with plural pins 61A without being formed integral therewith. Structural features and functional effect of this idler sprocket 60 other than those described above are substantially the same as is the case with that previously described.

During engine running, since the idle sprocket 60 is driven by the crankshaft (not shown) via the first chain 68, and therefore the two camshaft sprockets 51 are driven by the idle sprocket 60 via the second chain 69. In this case, a torque is applied from each camshaft 50 to each camshaft bearing portion 21 of the arch member 20 by a tension of the second chain 69, so that the two camshaft bearing portions 21(I) and 21(E) are deformed obliquely downward so as to oppose each other. However, the load applied to the two camshaft bearing portions 21 by the second chain 69 is effectively received by the arch member 20 supported by the right and left inner side walls 111 and 112 and the two stays 121 and 122 of the cylinder head 100, because two compression stresses generated on both sides of the arch member 20 in two opposite directions can effectively cancel each other horizontally without deforming the arch member 20.

Further, since the arch member 20 is formed with the arcuate surface 20A extending to the two inner side walls 111 and 122 of the cylinder head 100, the vertical compression stress generated at the arch member 20 can be divided into the two opposite inner side walls 111 and 122, thus it being possible to markedly increase the rigidity of the cylinder head 100 at the camshaft bearing portions 21(I) and 21(E) of the arch member 20.

In the above-mentioned construction, since the arch member 20 is located frontward away from the front end surface 120A (FIG. 3) of the upper deck 120, lubricant flowing from the camshafts 50 or other elements can be smoothly returned to an oil pan along the upper deck front end surface 120A and the front end surface **100*a* of the cylinder head 100**, without lubricant accumulation.

Furthermore, since the two camshafts 50 are supported by the arch member 20, it is possible to arrange the first chain sprocket wheel 60A near and along the inner arcuate surface 20A of the arch member 20, thus reducing the total length of a DOHC engine.

In the cylinder head for a DOHC engine according to the present invention, since the two camshafts 50 are supported symmetrically by the arch member 20 formed integral with the cylinder head 100 at the front driving end of the cylinder head in such a way that the inner arcuate surface 20A thereof extends to the right and left inside walls 111 and 112 of the cylinder head 100, it is possible to markedly increase the rigidity of the cylinder head at the front end portion at which the two camshafts 50 are driven, thus preventing journal scuff at the camshaft bearing portions 21.

Further, it is possible to reduce the dimensions and the weight of the DOHC engine by effectively arranging the first chain 68 under the arch member 20.

What is claimed is:

1. A cylinder head of a DOHC engine including two camshafts mounted on a cylinder head, wherein an arch member is formed integral with the cylinder head on a front camshaft driving side to support the two camshafts in such a way that an inner arcuate surface of said arch member extends to both inner side walls of the cylinder head.

2. The cylinder head of a DOHC engine of claim 1, wherein the two camshafts are supported by said arch member in symmetrical positional relationship to each other to cancel horizontal compression stresses generated in said arch member when the two camshafts are driven by a chain.

3. The cylinder head of a DOHC engine of claim 1, wherein said arch member is further reinforced by two stays formed integral with the cylinder head between a cylinder head upper deck and the inner arcuate surface of said arch member.

4. The cylinder head of a DOHC engine of claim 1, wherein said arch member is formed with a central recessed portion in the arcuate surface thereof between two camshaft supporting portions.

5. The cylinder head of a DOHC engine of claim 1, wherein said arch member is formed with two side recessed portions in the arcuate surface thereof below two camshaft supporting portions.

6. The cylinder head of a DOHC engine of claim 1, wherein a front end of said arch member is located frontward away from a front end surface of the cylinder head for providing a smooth lubricant downward flow along the front end surface of the cylinder head without lubricant accumulation.

7. The cylinder head of a DOHC engine of claim 1, wherein a camshaft driving chain is disposed under said arch member near and along the inner arcuate surface of said arch member to effectively utilize space under said arch member.

* * * * *